United States Patent [19]

Regan et al.

[11] 4,139,036

[45] Feb. 13, 1979

[54] SCREW STARTER

[76] Inventors: Joseph R. Regan, 102 Meadowbrook Rd., Spring Lake Heights, N.J. 07762; Robert R. Regan, 12 Prospect Dr., North Arlington, N.J. 07032

[21] Appl. No.: 805,379

[22] Filed: Jun. 10, 1977

[51] Int. Cl.[2] ..... B25C 3/00

[52] U.S. Cl. ..... 145/46; 145/30 R; 227/136

[58] Field of Search ..... 145/30 R, 46, 50 D; 227/136

[56] References Cited

U.S. PATENT DOCUMENTS

| | | | |
|---|---|---|---|
| 145,604 | 12/1873 | Ward | 145/30 R |
| 874,613 | 12/1907 | McColm | 145/46 |
| 1,688,445 | 10/1928 | Williams | 145/46 |
| 1,815,594 | 7/1931 | Shaw et al. | 145/52 |
| 1,839,490 | 1/1932 | Moeller | 144/32 UX |
| 2,433,223 | 12/1947 | Johnson | 145/30 R |
| 2,985,208 | 5/1961 | Hibbard et al. | 145/50 D |
| 3,009,155 | 11/1961 | Leniz | 145/46 |
| 3,245,446 | 4/1966 | Morifuji | 145/50 D |
| 3,250,308 | 5/1966 | March | 145/46 |
| 3,298,410 | 1/1967 | Morifuji | 145/52 |
| 3,374,934 | 3/1968 | Dickson | 227/136 |
| 3,554,246 | 1/1971 | Halstead | 227/136 |
| 3,563,438 | 2/1971 | Doyle | 227/136 |
| 3,601,168 | 8/1971 | Fernstrom | 144/32 R |
| 3,623,646 | 11/1971 | Cast | 227/136 |
| 3,656,520 | 4/1972 | Caffa | 227/136 |
| 3,847,193 | 11/1974 | Brunstetter | 145/50 D |
| 3,891,014 | 6/1975 | Gunn | 144/32 R |
| 3,910,324 | 10/1975 | Nasiatka | 227/136 |
| 3,915,367 | 10/1975 | Potucek | 227/136 |
| 4,018,254 | 4/1977 | DeCaro | 144/32 R |
| 4,062,389 | 12/1977 | Lejdegard | 227/136 |

FOREIGN PATENT DOCUMENTS

| | | | |
|---|---|---|---|
| 1405902 | 6/1965 | France | 145/50 D |
| 290135 | 11/1931 | Italy | 145/46 |
| 5414 of | 1893 | United Kingdom | 145/46 |

*Primary Examiner*—James L. Jones, Jr.
*Assistant Examiner*—J. T. Zatarga
*Attorney, Agent, or Firm*—Sughrue, Rothwell, Mion, Zinn and Macpeak

[57] ABSTRACT

A housing having top and bottom openings is provided with an interior flexible sheet containing a cross-slit for holding a screw in a vertically upright position. The bottom opening is placed over the point into which the screw is to be threaded. A screwdriver may be inserted through the top opening to engage the slot in the screw head so that the screw can be threaded. A plurality of screws can be similarly inserted into a plurality of cross-slits formed along the length of a strip in order sequentially to advance each screw into a position which is vertically aligned with the top and bottom openings. The strip may contain sprocket holes which are engaged by a sprocket mounted in a housing for advancing the strip. The strip may also be provided with detent holes for cooperation with a detent means mounted on the housing for facilitating the positioning of each screw. In addition, a spring-loaded screwdriver may be mounted in the top opening.

20 Claims, 17 Drawing Figures

FIG. 1
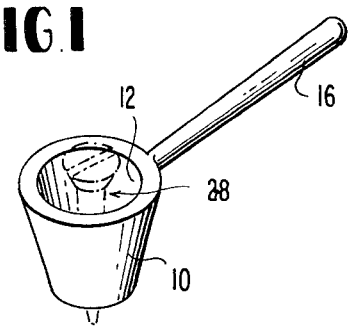
FIG. 2
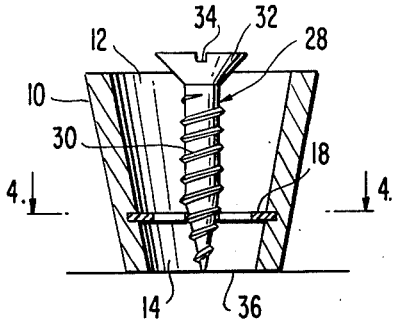
FIG. 4
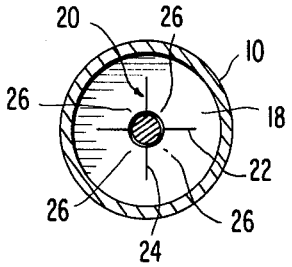
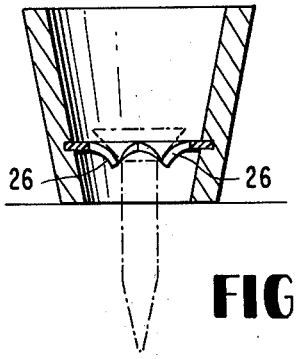
FIG. 3
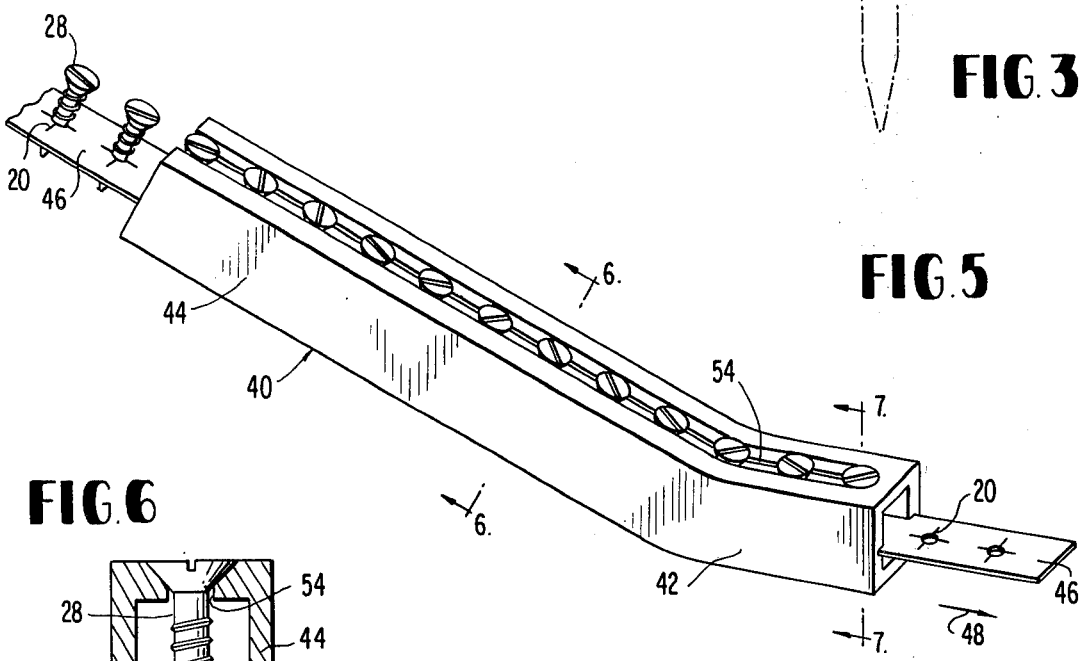
FIG. 5
FIG. 6
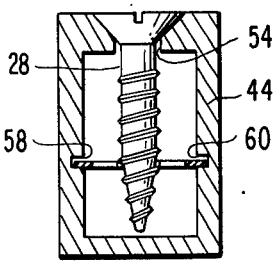
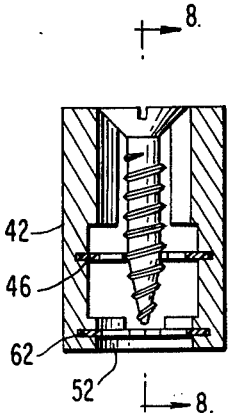
FIG. 7
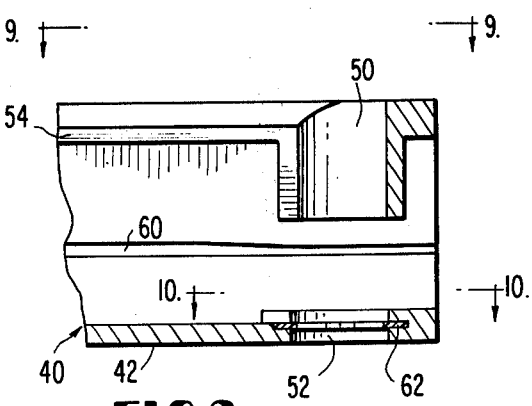
FIG. 8

FIG. 9
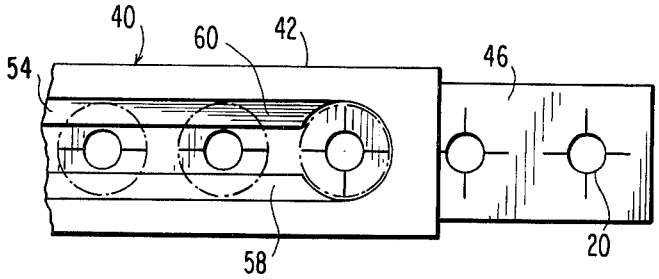
FIG. 10
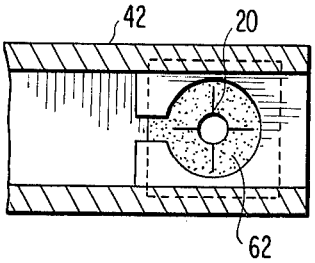
FIG. 12
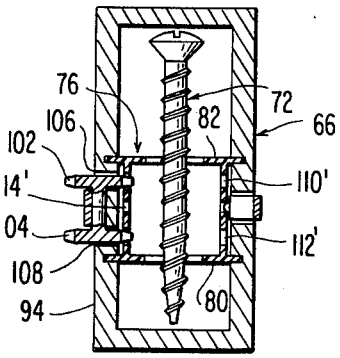
FIG. 13
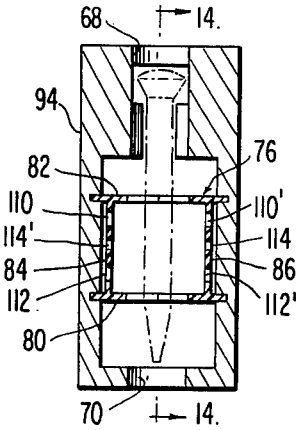
FIG. 14
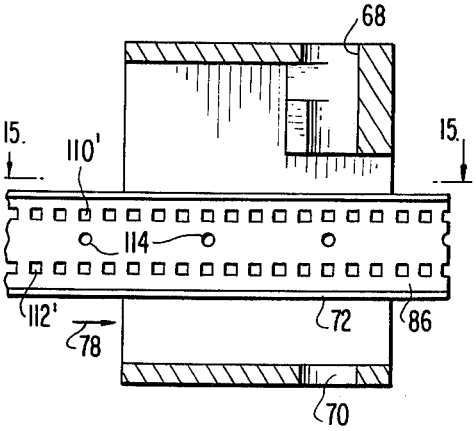
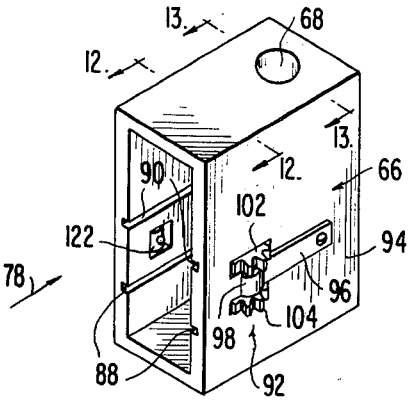
FIG. 11
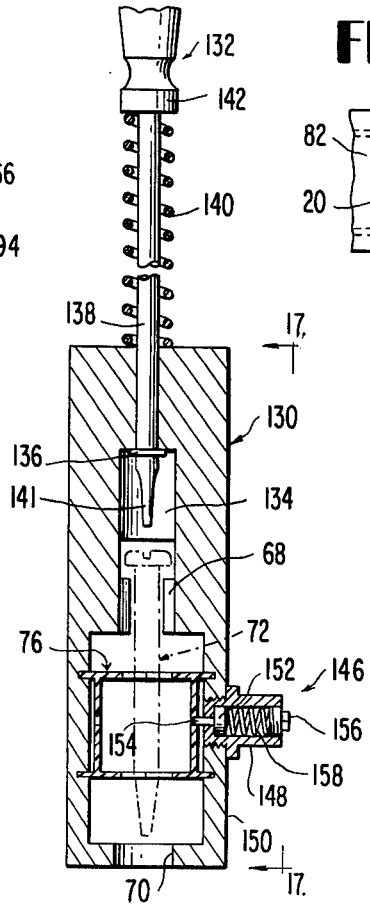
FIG. 16
FIG. 15
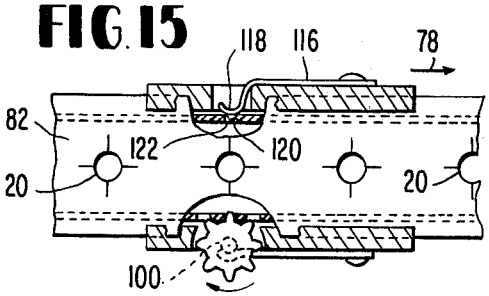
FIG. 17
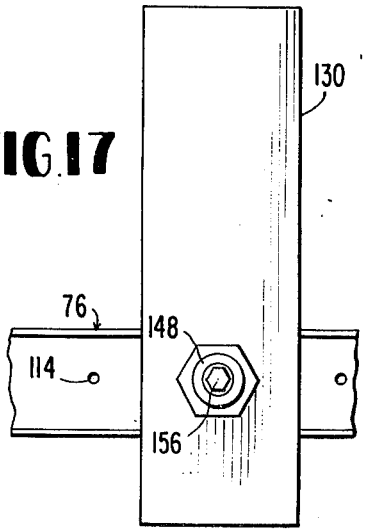

SCREW STARTER

BACKGROUND OF THE INVENTION

1. Field of the Invention

This invention relates generally to the field of starters or guides for frictional fasteners, such as screws and nails and, in particular, to a device for starting or guiding one or a plurality of screws.

2. Description of the Prior Art

There are many prior art devices which function as tools for starting, guiding, holding and/or positioning a friction fastener of the shank and head type, such as a screw or nail. Representative prior art devices are shown in the following U.S. Pat. Nos. 874,613; 2,716,750; 2,783,799; 2,802,211; 3,009,155; 3,060,442; 3,316,949; 3,522,827; 3,946,799, and Re. 28,159. However, these prior art devices tend to be relatively complicated and, therefore, relatively expensive. Furthermore, there are many applications wherein it would be desirable to have such a device through which a continuous strip of fasteners could be fed, thereby eliminating the need for the operator to insert individual fasteners into the device.

SUMMARY OF THE INVENTION

Therefore, the primary object of this invention is to provide a novel, relatively inexpensive device or tool for starting or guiding frictional fasteners, such as screws and nails.

Another object of this invention is to provide such a device or tool which will accommodate a strip of such fasteners such that the strip may be advanced through the tool sequentially to position the fasteners at a desired point.

BRIEF DESCRIPTION OF THE DRAWING

FIG. 1 is a perspective view of one embodiment of the invention for starting or positioning a single fastener, such as a screw.

FIGS. 2 and 3 are cross-sectional views of a portion of the embodiment illustrated in FIG. 1 and show in detail both the structure and operation of this embodiment.

FIG. 4 is a cross-sectional view taken along line 4—4 of FIG. 2.

FIG. 5 is a perspective view of another embodiment of the invention for accommodating a strip of fasteners, such as screws.

FIG. 6 is a cross-sectional view taken along line 6—6 of FIG. 5.

FIG. 7 is a cross-sectional view taken along line 7—7 of FIG. 5.

FIG. 8 is a cross-sectional view taken along line 8—8 of FIG. 7.

FIG. 9 is a view along line 9—9 of FIG. 8.

FIG. 10 is a cross-sectional view taken along line 10—10 of FIG. 8.

FIG. 11 is a perspective view of still another embodiment of the invention and includes sprocket and detent means for advancing a strip of fasteners through the starter device or tool.

FIG. 12 is a cross-sectional view taken along line 12—12 of FIG. 11.

FIG. 13 is a cross-sectional view taken along line 13—13 of FIG. 11.

FIG. 14 is a cross-sectional view taken along line 14—14 of FIG. 13.

FIG. 15 is a partially broken-away cross-sectional view taken along line 15—15 of FIG. 14.

FIG. 16 is a sectional view of another embodiment of the invention wherein a spring loaded screwdriver is formed integrally with the starter device or tool.

FIG. 17 is a partial side view of FIG. 16.

DETAILED DESCRIPTION OF THE PREFERRED EMBODIMENTS

FIGS. 1–4 illustrate one basic embodiment of the invention for starting a single frictional fastener of the head and shank type, such as a screw or nail.

This embodiment consists of a housing 10 in the form of a hollow truncated cone whose surface of revolution forms a wall having a top opening 12 which is of larger diameter than the bottom opening 14. The housing is made of rigid material, such as molded plastic. A rigid handle 16 is fixed to the housing and may be molded integrally with the housing 10. A circular sheet member 18 is mounted in a horizontal plane within a circular slot of the housing 10. This sheet member may be secured in the slot by a suitable adhesive. The sheet member may be made of flexible plastic or cardboard, for example. A cross-slit 20 is formed in the center of the sheet member 18. This cross-slit consists of two slits 22 and 24 intersecting at right angles in the center of the sheet member 18 to form four deformable tab portions 26.

In operation, a frictional fastener, such as a screw 28 having a threaded shank 30 and a head 32 having a screwdriver slot 34 is inserted through the center of the cross-slit 20. As the screw is inserted through the cross-slit, the tab portions 26 frictionally engage the threaded shank 30 to hold the screw in a vertically upright position. Since the sheet 18 is located in the lower half of the housing 10, the tab portions engage the screw at its lower end which has a smaller diameter than the upper body of the shank. There may be formed in the center of the cross-slit a small hole of approximately the same diameter as the portion of the shank which is engaged by the sheet member 18. On the other hand, this hole is not necessary, and the screw may be merely inserted through the center of the cross-slit, resulting in a slight downward deformation of the tabs 26.

In any event, when a mechanic begins to drive the screw 28 into the workpiece 36 by rotating the screw with a screwdriver, as the screw moves downwardly, the larger diameter of the upper portion of the shank 30 and of the screw head 32, causes further downward deformation of the tabs 26 to permit the complete screw to pass through the cross-slit into the work. The length of the slits 22 and 24 is such that a circle circumscribing the cross-slit has a larger diameter than the diameter of the screw head 32.

As can be seen, during positioning and starting of the screw, the screw is firmly held in the desired upright position over the point of the workpiece into which the screw is to be driven.

FIGS. 5–10 show another embodiment of a novel screw starter which will accommodate a strip of screws.

More specifically, there is shown an elongated hollow housing 40 of substantially rectangular cross-section and having a lower horizontal portion 42 and an upwardly inclined portion 44. A flexible strip 46, made of plastic or cardboard, for example, has a plurality of spaced cross-slits 20 into each of which is inserted a frictional fastener, such as screws 28. In operation, the strip 46 is pulled by the operator in the direction of the arrow 48.

Formed in the right-hand end of housing 40 is a top opening 50 of larger diameter than that of the screw head. Formed in the bottom of the housing 40 is a bottom opening 52 in vertical alignment with the opening 50. These top and bottom openings 50 and 52 correspond with the top and bottom openings 12 and 14 in FIG. 2.

There is formed in the top surface of the portions 42 and 44 of housing 40 an elongated slot 54 which is in communication with the top opening 50. This slot has downwardly and inwardly inclined walls to form a slot which has a smaller width than the diameter of the screw heads so that the screw heads are supported in the slot without falling through the slot.

For supporting the strip 46 and permitting sliding movement thereof through the housing 40, there are formed in the opposite walls of the housing 40, slots 58 and 60 which are slightly wider than the thickness of the strip 46 in order to permit the strip to slide easily through these slots. The widths of these slots are reduced in the area of the top and bottom openings 50 and 52 in order to eliminate any wobbling of the strip and screw when the screw is in position for driving into a workpiece.

Secured in the bottom opening 52 is a circular flexible sheet member 62, also having a cross-slit 20. This sheet member corresponds to the sheet member 18 in FIG. 2.

In operation, the strip 46 carrying a plurality of screws 28 is manually pulled through the housing by the operator sequentially to place the screws into alignment with the top and bottom openings 50 and 52 where they may be driven by a screwdriver into a workpiece which is in contact with the horizontal portion 42 of the housing 40. The inclined portion 44 of the housing 40 serves as a handle for the operator.

FIGS. 11–15 illustrate another embodiment of the invention wherein a screw-carrying strip is provided with sprocket holes for permitting the strip to be advanced through the screw starter housing by means of a sprocket wheel.

More specifically, this embodiment includes a hollow rectangular housing 66 having a top opening 68 for receiving a screwdriver and a bottom opening 70 which is placed in contact with the workpiece at the point at which a frictional fastener, such as a screw 72, is to be driven. A screw carrier 76 is adapted to be advanced through the housing 66 in the direction of the arrow 78. This carrier includes two horizontal flexible strips 80 and 82 joined together by a pair of substantially rigid vertical side walls 84 and 86. The flexible strips 80 and 82 contain horizontally spaced pairs of vertically aligned cross-slits 20 of the same type as used in the previous embodiments. A screw 72 is inserted through each pair of vertically aligned cross-slits. This embodiment is particularly useful for long screws, as the double-strip configuration of the carrier will maintain such screws in a vertically upright position. The outer edges of the strips 80 and 82 slide in appropriately dimensioned corresponding pairs of slots 88 and 90 formed in the inner walls of the housing 66.

A sprocket wheel assembly 92 is mounted in the right side wall 94 of the housing by means of a spring clip 96 having a curved portion 98 which biases the shaft 100 of the sprocket assembly inwardly against the housing wall 94, thereby clamping the sprocket assembly against the wall while permitting rotation of the assembly. Two sprocket wheels 102 and 104 are fixed to opposite ends of this shaft and protrude inwardly of the housing through corresponding slots 106 and 108.

A series of appropriately spaced sprocket holes 110 and 112 are formed in the left wall 84 of the carrier 76 for engagement by the two sprocket wheels 102 and 104. Consequently, it can be seen that clockwise rotation of the sprocket assembly 92 will advance the carrier 76 in the direction of the arrow 78, sequentially to present successive screws to a position vertically aligned with the top and bottom openings 68 and 70 of the housing 66.

There may also be provided in the opposite vertical wall 86 a series of spaced detent holes 114 aligned along the center of the side wall.

Mounted on the side wall 94 is a detent arm 116 made of spring steel and having an inwardly biased loop portion 118 carrying a small projection 120 which is adapted to snap into the detent holes 114 as they move past the opening 122 in the side wall. The detent holes 114 are aligned with the centers of the cross-slits 20 and spaced the same distance apart as the cross-slits so that a detent hole appears opposite the opening 122 each time a screw is vertically aligned with the top and bottom openings 68 and 70. When the operator feels the momentary resistance to advancement of the screw carrier because of the action of the detent lever 116, he knows that a screw is properly positioned for driving. Optional sprocket holes 110', 112' and detent holes 114' may be formed in side walls 86 and 84, respectively.

If desired, a flexible sheet having a central cross-slit may be inserted in the opening 70 of housing 66 in the manner shown in FIG. 7 wherein the flexible sheet 62 is inserted in the bottom opening 52 of the housing portion 42.

FIGS. 16 and 17 illustrate another embodiment of the invention wherein a spring loaded screwdriver is mounted within the top opening in the housing of the starter device. More specifically, FIG. 16 shows a housing 130 which is a modified version of the housing 66 of the previous embodiment. The modification can be easily seen by comparing the cross-sectional views shown in FIGS. 13 and 16. The housing 130 is made higher at least in the area of the top opening 68 to accommodate a screwdriver 132 which extends through a bore hole in the top of the housing into an opening 134 above the opening 68. A collar 136 is fixed to the screwdriver shaft 138 just above the screwdriver blade 141 to prevent the screwdriver from being withdrawn from the housing 130. The screwdriver shaft is inserted through a spring 140 which is slightly under compression by virtue of its being confined between the top wall of the housing 130 and the lower end of the screwdriver handle 142.

Because of the force of the spring 140, the screwdriver is normally maintained in its upwardmost position as illustrated in FIG. 16. When a screw 72 is in position to be driven into a workpiece, the mechanic merely presses the screwdriver downwardly against the force of spring 140 to engage the slot in the screw head.

FIGS. 16 and 17 also illustrate a detent assembly 146 which may be substituted for the detent lever 116 and associated elements of the previous embodiment. Detent assembly 146 includes a threaded hollow bushing 148 which is threaded into the side wall 150 of the housing 130. Mounted within the hollow bore of the bushing is a plunger 152 having a tip 154 which is dimensioned to fit within the detent holes 114 in the screw carrier 76.

The outer end of the bushing 148 has interior threads for receiving a threaded adjusting bolt 156. Disposed between the piston 152 and the adjusting bolt 156 is a spring which is maintained under compression to bias the plunger 152 inwardly of the housing 130. The bias force against the plunger 152, and thus the stiffness of the detent action, is controlled by rotating the adjusting bolt 156 so that it moves inwardly or outwardly to adjust the compression, and thereby the force, of the spring 158.

There have been disclosed above several embodiments of the invention which also includes obvious variations and modifications of the disclosed embodiments. The scope of the invention is defined by the following claims.

We claim:

1. A starter device for a frictional fastener of the shank and head type, comprising, in combination:

a housing having vertically aligned top and bottom openings; and a horizontal flexible sheet mounted inside said housing a predetermined distance above the bottom opening and having a cross-slit for receiving a frictional fastener and holding it in a vertically upright position, said cross-slit being vertically aligned with said top and bottom openings.

2. The invention of claim 1 further comprising, in combination, a frictional fastener having a head and a shank, the shank being inserted through said cross-slit whose circumscribing circle has a diameter larger than the diameter of said head, said cross-slit forming downwardly deformable tab portions for permitting the fastener to be driven through the cross-slit into a workpiece.

3. The invention of claim 2 wherein said fastener is a screw.

4. The invention of claim 1 wherein said sheet contains a center hole whose diameter is less than the maximum diameter of the threaded shank of a screw to be inserted in said hole, said cross-slit being centered on said hole and forming downwardly deformable tab portions which permit the head of the screw to pass through said hole when said portions are deformed by downward pressure of the screw-head.

5. The invention of claim 1 wherein said flexible sheet is located between the top and bottom of said housing.

6. The invention of claim 5 wherein said flexible sheet is located nearer the bottom of said housing than the top.

7. The invention of claim 1 wherein said housing has the shape of a hollow truncated cone, the bottom opening having a smaller diameter than the top opening.

8. The invention of claim 1 wherein said housing has a substantially horizontal portion containing a horizontal elongated slot, in combination with said top opening, for supporting the heads of a plurality of screws;

said device further comprising flexible strip means having horizontally disposed opposite flat surfaces containing a plurality of horizontally spaced screw holes for holding the threaded shanks of a plurality of screws, a cross-slit centered on each of said holes, said strip means being slidably movable along said portion for sequentially aligning the holes with said top and bottom openings in said housing.

9. The invention of claim 8 further comprising, in combination, a spring-biased screwdriver mounted on said housing in vertical alignment with said top and bottom openings.

10. The invention of claim 8 wherein said housing has an upwardly inclined portion which serves as a handle for said device wherein said elongated slot extends the length of said inclined portion, and wherein said strip means is also slidably movable along said inclined portion.

11. The invention of claim 8 further comprising, in combination, a plurality of screws whose heads are supported by said elongated slot for sliding movement along said slot and whose threaded shanks are inserted in respective ones of said holes in said flexible strip means, each screw head being exposed to the exterior of said housing through said top opening.

12. The invention of claim 8 wherein said flexible strip means is a single flexible strip.

13. The invention of claim 8 wherein said flexible strip means comprises a pair of substantially horizontal parallel strips mounted for sliding movement along said extension and joined together by vertical side walls which are horizontally spaced apart, said holes being arranged in vertically aligned pairs in said horizontal strips, a plurality of sprocket holes horizontally spaced along at least one of said vertical side walls, and sprocket means rotatably mounted in the housing adjacent said one vertical side wall for engaging said sprocket holes to advance said strip means toward the bottom opening in said housing.

14. The invention of claim 13 wherein said strip means further comprises a plurality of horizontally spaced detent holes in the other of said vertical side walls, the spacing between the sprocket holes being the same as the spacing between said vertically aligned pairs of said screw holes, and detent means mounted on said housing adjacent said other vertical side wall for sequentially engaging said detent holes as said strip means is advanced.

15. The invention of claim 1 further comprising, in combination, spring-loaded screwdriver means mounted on said housing in vertical alignment with said top and bottom openings for engaging the slot of the head of a screw inserted in said cross-slit.

16. A screw starter device comprising, in combination:

a rectangular housing having open front and rear ends and a top wall, a bottom wall, and left and right side walls;

a screwdriver opening in said top wall;

a screw opening in said bottom wall and vertically aligned with said screwdriver opening;

the interior of said side walls having respective horizontal slots for slidably receiving a flexible strip carrying a plurality of vertically oriented, horizontally spaced screws and containing sprocket holes horizontally spaced along the length thereof; and rotatable sprocket means mounted on one of said side walls and extending therethrough for engaging said sprocket holes for advancing the flexible strip from one end of said housing to the other.

17. The invention of claim 16 further comprising, in combination, a spring-biased screwdriver mounted in said screwdriver opening, and means for preventing said screwdriver from being removed from said housing.

18. The invention of claim 16 further comprising, in combination, a flexible strip slidably mounted in said slots and carrying a plurality of vertically aligned screws in a plurality of horizontally spaced cross-slits in said strip, said strip having a plurality of sprocket holes horizontally spaced along its length.

19. The invention of claim 18 further comprising, in combination, a spring-biased screwdriver mounted in said screwdriver opening, and means for preventing said screwdriver from being removed from said housing.

20. The invention of claim 18 wherein said flexible strip also has a plurality of detent holes spaced along its length with the same spacing as said cross-slits, and further comprising detent means mounted on the other of said side walls and extending therethrough for engaging said detent holes.

* * * * *